US006809301B1

(12) United States Patent
McIntyre et al.

(10) Patent No.: US 6,809,301 B1
(45) Date of Patent: Oct. 26, 2004

(54) OVEN CONTROL METHOD AND APPARATUS

(75) Inventors: Michael Lee McIntyre, Cox's Creek, KY (US); Mark Heimerdinger, Louisville, KY (US); Wolfgang Daum, Erie, PA (US); Sergio Alberto Vinocur, Louisville, KY (US)

(73) Assignee: General Electric Company, Schenectady, NY (US)

( * ) Notice: Subject to any disclaimer, the term of this patent is extended or adjusted under 35 U.S.C. 154(b) by 204 days.

(21) Appl. No.: 09/609,560

(22) Filed: Jun. 30, 2000

(51) Int. Cl.[7] ..... H05B 1/02

(52) U.S. Cl. ..... 219/506; 219/720; 219/715; 219/492; 99/325

(58) Field of Search ..... 219/490, 411–414, 219/492, 501, 502, 497, 506, 440–450, 714, 715, 720, 491; 99/325

(56) References Cited

U.S. PATENT DOCUMENTS

| | | | | |
|---|---|---|---|---|
| 4,011,428 A | | 3/1977 | Fosnough et al. | |
| 4,309,584 A | | 1/1982 | Terakami | |
| 4,341,197 A | | 7/1982 | Butts | |
| 4,390,766 A | | 6/1983 | Horinouchi | |
| 4,418,262 A | | 11/1983 | Noda | |
| 4,447,692 A | | 5/1984 | Mierzwinski | |
| 4,517,429 A | * | 5/1985 | Horinouchi | 219/720 |
| 4,568,810 A | | 2/1986 | Carmean | |
| 4,695,711 A | | 9/1987 | McGeorge | |
| 5,345,067 A | | 9/1994 | Ohta et al. | |
| 5,352,874 A | | 10/1994 | Gong | |
| 5,426,280 A | | 6/1995 | Smith | |
| 5,438,180 A | | 8/1995 | Eisenbrandt et al. | |
| 5,877,477 A | | 3/1999 | Petty et al. | |
| 5,990,460 A | * | 11/1999 | Petty et al. | 219/497 |
| 6,080,972 A | * | 6/2000 | May | 219/494 |
| 6,097,016 A | * | 8/2000 | Hirata et al. | 219/720 |
| 6,587,739 B1 | * | 7/2003 | Abrahams et al. | 700/83 |

* cited by examiner

*Primary Examiner*—Mark Paschall
(74) *Attorney, Agent, or Firm*—H. Neil Houser, Esq.; Armstrong Teasdale LLP

(57) ABSTRACT

A control system for a an oven having at least one cooking element and a surface warmer includes a microprocessor, a memory, and a user input interface for user entry of cooking recipes including a cooking mode, an oven temperature, and a cooking time. Up to five favorite recipes can be stored in system memory for selection by a user, and two recipes can be combined for automatic sequential execution. The surface warmer is operable upon manipulation of two input selectors within a pre-determined time, and a preheat algorithm preheats the surface warmer by applying a 100% duty cycle to the surface warmer until an oven thermal limiter input switch reaches a predetermined temperature.

19 Claims, 6 Drawing Sheets

OVEN CONTROL METHOD AND APPARATUS

BACKGROUND OF THE INVENTION

This invention relates generally to controls for electric range ovens, and, more particularly, to keypad controls for oven ranges.

Electronic, touch sensitive, glass control interfaces are becoming increasingly popular in modem range ovens to control a variety of cooking elements located atop and within a range cabinet. In one type of oven range, the heating elements include a plurality of radiant cooking elements on a top surface of the cooking cabinet, otherwise known as burners, as well as one or more internal cooking elements, such as a bake element and a broil element in a cabinet cooking cavity. Known electronic controls have facilitated expanded oven features beyond conventional mechanically controlled ranges, but tend to be cumbersome and difficult to new users, and tedious and time consuming for other users.

In use, certain oven baking operations are frequently executed that correspond to frequently prepared dishes or baked goods. Control settings, e.g., cooking time and temperature settings, however, typically must be manually entered with each cooking operation, and must be re-entered to switch settings in a cooking operation, or to execute a new cooking cycle. Further, recipes for some dishes, such as quiche, apple pies, pumpkin pies, and cheese cake, require different baking temperatures at different stages in the recipe, for example, a first higher temperature for a certain time period, and a second lower temperature for a second time period. Such recipes require close monitoring of cooking cycles to adjust oven settings at the appropriate time. It would be desirable to provide an oven with programmable cooking routines that are easily accessible without reentering an entire recipe sequence at each cooking operation, and further that automatically accommodates different baking temperatures at different stages in a selected recipe.

In addition, at least one type of known induction cooktop for an oven range includes a surface warmer in addition to cooking burners. Known control systems for surface warmers tend to be sluggish and difficult to use. It would be desirable to provide an easy to use and quickly responsive control interface for a surface warmer.

BRIEF SUMMARY OF THE INVENTION

In an exemplary embodiment, a control system for an oven having at least one cooking element includes a microprocessor operatively coupled to the cooking element, a memory for storing cooking element command recipes for execution by the microprocessor; a display coupled to the microprocessor for displaying operating conditions and oven features, and a user input interface coupled to the microprocessor for user entry of cooking recipes. The microprocessor and the memory are configured to execute at least one of a user-programmed multi-stage cooking recipe and a user programmed favorite recipe recalled from memory in response to manipulation of the user input interface.

More specifically, the microprocessor and memory are configured to execute cooking element command recipes including a cooking mode, an oven temperature, and a cooking time. Up to five frequently used recipes, or favorite recipes, can be stored in system memory for selection by a user. If selected, the microprocessor recalls and executes the stored recipes. Thus, an oven user need not re-enter favorite recipes with each cooking session.

The microprocessor and memory are also configured to execute a multi-stage cooking recipe including a first cooking mode, a first oven temperature, and a first cooking time followed by a second cooking mode, a second oven temperature, and a second cooking time without intervention by a user. Thus, at least two recipes can be combined for automatic sequential execution by the microprocessor. Recipes for dishes requiring different baking temperatures at different stages in the recipe can therefore be cooked unmonitored by the user.

In one embodiment, the oven also includes a surface warmer operatively coupled to the microprocessor and operable at a plurality of power levels., and the input interface includes at least two surface warmer operation input selectors. The microprocessor is configured to operate the surface warmer only upon manipulation of both the first and said second surface warmer input selectors within a predetermined time, and preheats the surface warmer by applying a 100% duty cycle to the surface warmer until an oven thermal limiter input switch reaches a predetermined temperature. Thus, the surface warmer is easily and readily heated for use.

DETAILED DESCRIPTION OF THE INVENTION

Figure 1:
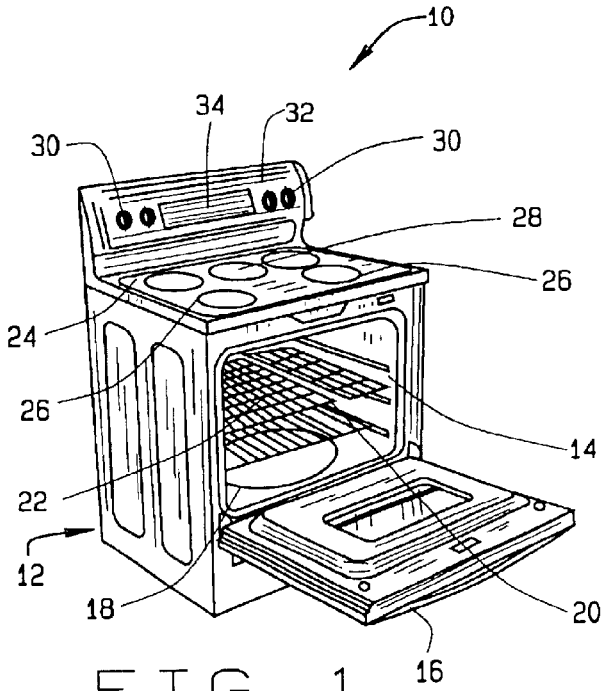
FIG. 1 is a perspective view of a range oven.

FIG. 1 is a perspective view of a range oven 10 including a cabinet 12 defining a cooking cavity 14 accessible with a hinged door 16. In accordance with conventional ovens, cooking cavity 14 contains a broil heating element (not shown in FIG. 1) mounted to a ceiling (not shown) of oven cooking cavity 14, a bake element (not shown in FIG. 1) mounted to a floor 18 of oven cooking cavity 14, and a convection bake element fan (not shown in FIG. 1) mounted to a rear wall (not shown) of oven cooking cavity 14. Food is placed on removable oven racks 20 for heating by the baking element or convection bake element, or a broiler pan and grid 22 for heating by the broiler element.

An oven cooktop 24 includes a plurality of surface heater elements 26 and a surface warmer element 28 of reduced power relative to surface heater elements 26. Surface heater elements 26 are controlled by respective control knobs 30 on control panel 32 extending above cooktop 24, and remaining oven cooking elements (i.e., the broil element, the bake element, the convection and bake element, and surface warmer 28) are selectively operable by manipulation of an electronic input interface panel 34 and controlled by methods described below.

While the particular embodiment described and illustrated herein is in the context of a range oven, such as oven 10, it is contemplated that the benefits of the invention accrue to other types of ovens and control systems for other types of known heating elements, including but not limited to radiant cooking elements, microwave cooking elements, RF cooking elements, gas cooking elements, induction cooking elements, and light cooking elements. In addition, known reflecting elements and the like to focus heat energy in particular portions of oven cooking cavity 14 are employed in alternative embodiments of the invention. Therefore, oven 10 is described for illustrative purposes only and not by way of limitation.

Figure 2:
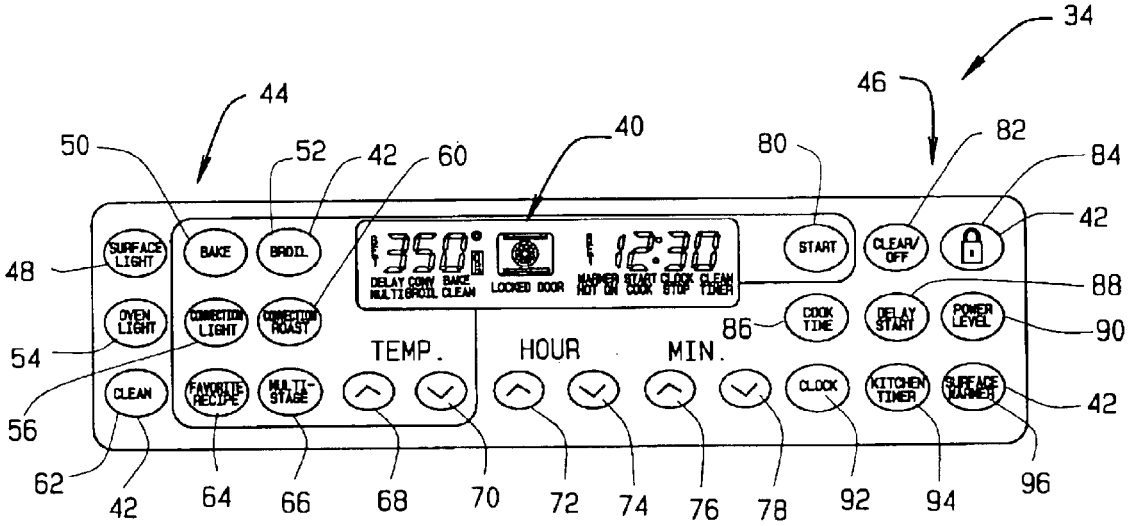
FIG. 2 illustrates a control panel interface and display for the oven shown in FIG. 1.

FIG. 2 illustrates input interface panel 34 including a display 40 and a plurality of input selectors 42 in the form of touch sensitive buttons or keypads for accessing and selecting oven features. In alternative embodiments, other known input selectors are used in lieu of touch sensitive switches.

More specifically, input selectors 42 are divided into two groups 44, 46. Group 44 includes a SURFACE LIGHT keypad 48, a BAKE keypad 50, a BROIL keypad 52, an OVEN LIGHT keypad 54, a CONVECTION BAKE keypad 56, a CONVECTION ROAST keypad 60, a CLEAN keypad 62, a FAVORITE RECIPE keypad 64, a MULTI-STAGE keypad 66, a temperature up (^) slew keypad 68 and a temperature down (v) slew keypad 70. Group 46 includes an hour up (^) slew keypad 72 and an hour down (v) slew keypad 74, a minute up (^) slew keypad 76 and a minute down (v) slew keypad 78, a START keypad 80, a CLEAR/OFF keypad 82, a LOCK keypad 84, a COOK TIME keypad 86, a DELAY START keypad 88, a POWER LEVEL keypad 90, a CLOCK keypad 92, a KITCHEN TIMER keypad 94, and a SURFACE WARMER keypad 96. Operation of keypads 48 to 96 will be in part apparent and in part pointed out hereinafter.

In alternative embodiments, it is contemplated that other keypad arrangements, including greater or fewer keypads, could be used within the scope of the present invention for accessing and selecting features of a particular oven. It is further contemplated that the algorithms described herein could be employed with a numeric input keypad (not shown), such as a plurality of numbered keys labeled "0" through "9" on key scripts or icons to directly input cooking parameters in lieu of slew keys.

Figure 3:
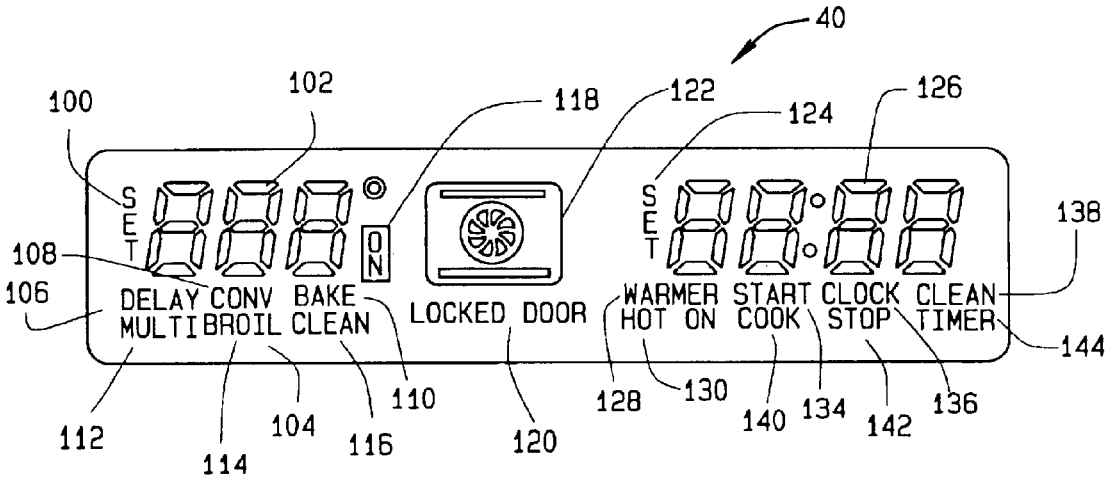
FIG. 3 is an enlarged view of the display shown in FIG. 2.

FIG. 3 is an enlarged view of display 40 including an oven SET indicator 100, a temperature indicator 102, an oven function indicator 104 including a DELAY indicator 106 for delayed start, CONV indicator 108 for convection heating, BAKE indicator 110 for baking, MULTI indicator 112 for multi-stage heating, BROIL indicator for broiling 114, and a CLEAN indicator 116 for a self-cleaning mode. Display 40 further includes an oven ON indicator 118, a LOCKED DOOR indicator 120, and a graphical function indicator 122 for indicating broiler, convection fan, and bake element heating. Further, display 40 includes a surface warmer SET indicator 124, a time indicator 126, a surface WARMER indicator 128 and associated HOT 130 and ON 132 indicators, a START indicator 134, a CLOCK indicator 136, a CLEAN indicator 138, a COOK indicator 140, a STOP indicator 142, and a TIMER indicator 144. Operation of the various indicators will be in part apparent and in part pointed out hereinafter.

In alternative embodiments, it is contemplated that other display indicator arrangements, including greater or fewer numbers of indicators, could be used within the scope of the present invention for displaying features of a particular oven.

Figure 4:
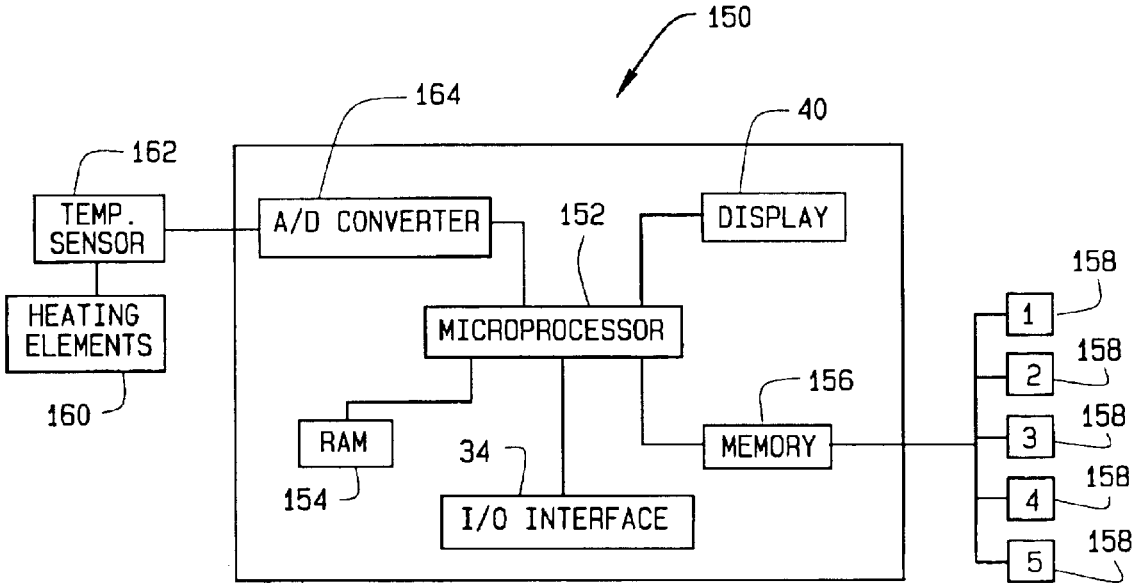
FIG. 4 is a block diagram of a control system for the oven shown in FIG. 1.

FIG. 4 is a block diagram of a control system 150 for oven 10 (shown in FIG. 1) including a microprocessor 152 coupled to input interface 34 and to display 40, and including a RAM memory 154 and permanent memory 156, such as an EEPROM or ROM memory known in the art, for storing cooking recipes. In a particular embodiment, memory 156 includes five registers 158 for storing five favorite or frequently used recipes. In alternative embodiments, greater of fewer than five registers 158 are included to store greater or fewer than five recipes. For a given cooking session, microprocessor 152 receives input commands from either input interface 34 or memory 156 and stores the commands in memory 156 or recalls commands from memory 156 and loads control data into RAM 154 for execution of a cooking routine by microprocessor 152. Microprocessor 152 is operatively coupled to oven heating elements 160 (i.e., the oven bake element, broil element, convection element, and cooktop surface heating units) for energization thereof through relays, triacs, or other known mechanisms (not shown) for cycling power to oven heating elements. One or more temperature sensors 162, including but not limited to a known thermal limiter input switch to monitor a surface temperature of cooktop 24 (shown in FIG. 1), sense operating conditions of oven heating elements 160 and are coupled to an analog to digital converter (A/D converter) 164 to provide a feedback control signal to microprocessor 152.

Figure 5:
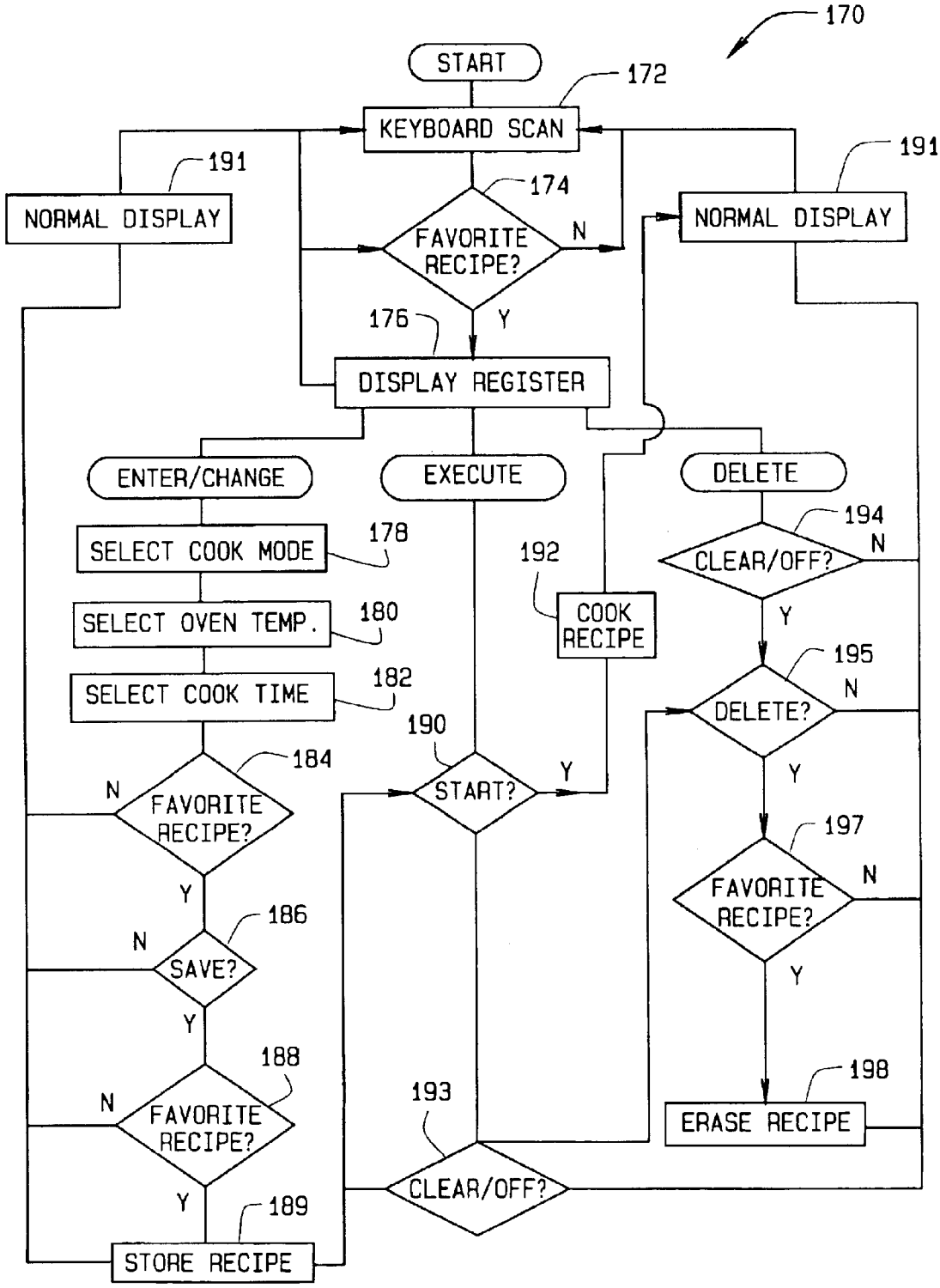
FIG. 5 is a method flowchart of a favorite recipe algorithm executable by the control system shown in FIG. 4.

FIG. 5 is a method flowchart of a favorite recipe algorithm 170 executable by control system 150 (shown in FIG. 4). Input interface 34 (shown in FIG. 2) is scanned 172 for activation by the user. When FAVORITE RECIPE keypad 64 (shown in FIG. 2) is depressed 174, microprocessor 152 (shown in FIG. 4) displays 176 the contents of a first memory register 158 (shown in FIG. 4) containing a user programmed recipe including a cooking mode, a cook time, and an oven temperature. If FAVORITE RECIPE keypad 64 is pressed 174 again, the contents of a second memory register 158 containing a user programmed recipe are displayed 176. In similar fashion, other user programmed recipes are displayed 176 upon depressing 174 FAVORITE RECIPE keypad 64.

In one embodiment, if any register 158 is blank or empty, i.e., does not contain a recipe, oven temperature indicator 102 (shown in FIG. 3) is blank, time indicator 126 (shown in FIG. 3) is blank, and oven function indicators BAKE 110 and CONV 108 flash alternatively on display 40 (shown in FIG. 3). In an alternative embodiment, another indicator, such as a flashing number, is displayed to indicate the empty register. Thus, if register "1" is blank, a flashing "1" is displayed. If register "2" is empty, a flashing "2" is displayed, etc.

In similar fashion, the user may scroll through remaining empty registers 158, but empty registers 158 are not displayed 176 until all user programmed recipes are displayed. Thus, microprocessor 152 does not necessarily display 176 the contents of registers 158 in sequential order. When the contents of register "5" are displayed 176 and FAVORITE RECIPE keypad 64 is depressed, microprocessor 152 reverts to register "1" for continuous scrolling through memory registers 158.

To change a user programmed favorite recipe or to enter a favorite recipe into an empty register 158, the process is the same. FAVORITE RECIPE keypad 64 is depressed 174, repeatedly, if necessary, as described above until the appropriate register 158 in which a recipe is to be entered or changed is displayed 176. The user then depresses one of BAKE keypad 50, CONVECTION BAKE keypad 58, or CONVECTION ROAST keypad 60 (shown in FIG. 2) to select 178 a cooking mode. Temperature up (^) slew keypad 68 (shown in FIG. 2) or temperature down (v) slew keypad 70 is depressed to select 180 an oven temperature, and with each touch of slew keypads 68, 70, a default temperature setting, such as 350° F. is increased or decreased by 5° F. A cooking time is selected 182 by pressing HOUR or MINUTE up (^) slew keypads 72, 76, respectively (shown in FIG. 2), or HOUR or MINUTE down (v) slew keypads 74, 78, respectively.

In one embodiment, BROIL keypad 52 (shown in FIG. 2) is an invalid cooking mode for a favorite recipe because of no corresponding set cooking time for a typical broiling session. Likewise, self-clean is not considered a cooking mode and is likewise an invalid cooking mode for a favorite recipe. In an alternative embodiment, the broil function can be activated and controlled as a favorite recipe provided that time and temperature functionality, or relationship, is known and entered as control inputs.

Once cooking mode, oven temperature, and cooking time have been selected 178, 180, 182 by the user, if FAVORITE RECIPE keypad 64 is again depressed 184, "SAVE" is displayed 186 on display time indicator 126, oven function indicator 122 (shown in FIG. 3) flashes, and a notification tone is sounded. If FAVORITE RECIPE keypad 64 is depressed 188 again, the newly entered or modified favorite recipe is stored 189 in system memory 156 (shown in FIG. 4). If no input interface keypads are depressed and no cooking modes are active, i.e., the cooking elements are de-energized, system 150 times out, exits favorite recipe mode, and a "normal" display is indicated 191 on display 40 (shown in FIG. 3). It is appreciated that the normal display may vary for specific ovens with various features, but in one embodiment, a normal display includes time indicator 126 (see FIG. 3) indicating the current time of day.

Once a favorite recipe is stored or changed, it may be executed by pressing 190 START keypad 80 (shown in FIG. 2), or the user may manually exit favorite recipe mode by pressing 193 CLEAR/OFF keypad 82 (shown in FIG. 2). If START keypad 80 (shown in FIG. 2) is depressed, microprocessor 152 loads recipe command data from the applicable memory register 158 and displays the recipe parameters, i.e., the cook time, the oven temperature, and the cook mode. Microprocessor 152 then proceeds to a normal control routine and the applicable cooking mode is entered 192.

To execute a previously stored favorite recipe, FAVORITE RECIPE keypad 64 is depressed 174 until the appropriate recipe is displayed 176, and START keypad 80 is depressed 190. CLEAR/OFF keypad 82 is used to clear display 40 and exit favorite recipe mode.

To delete a favorite recipe from a register, FAVORITE RECIPE keypad 64 is depressed 174 until the recipe to be deleted is displayed 176. If CLEAR/OFF keypad 82 is depressed 194, "dEL" is displayed 195 in time indicator 126 (shown in FIG. 3), oven function indicator 122 is flashed, and a notification tone sounds. If FAVORITE RECIPE keypad 64 is depressed 196 again, the recipe is deleted 198 and display 40 is cleared. Delete mode is cancelled by depressing CLEAR/OFF keypad 82. Alternatively, if no input interface keypads are depressed and no cooking modes are active, i.e., the cooking elements are de-energized, system 150 times out, exits favorite recipe mode, and a "normal" display is indicated 191 on display.

Thus, favorite recipe mode facilitates simple access to frequently desired pre-defined cooking recipes that may be executed without manually re-entering cooking mode, oven temperature, and cooking time for each cooking session using the selected recipe(s). In one embodiment, preheat times are added into the user programmed recipe, and a preheat notification tone sounds when oven 10 is preheated and ready for food to be placed therein.

Input interface 34 keypad response during favorite recipe mode is summarized in the following table:

| KEYPAD | EMPTY REGISTER | PROGRAMMED RECIPE |
|---|---|---|
| Slew keys | Ignored, no beep | Ignored, no beep |
| Lights | Active | Active |
| Broil | Beeps and ignored | Beeps and ignored |
| Clean | Beeps and ignored | Beeps and ignored |
| Multi-Stage | Beeps and ignored | Beeps and ignored |
| Cancel | Beeps and cancels out | 5 beeps and prompts for DEL |
| Start | Beeps and cancels out | Starts recipe |
| Delay Start | Beeps and start time entry | Beeps and start time entry |
| Timer | Beeps and ignored | Beeps and 'PUSH START' |
| WARMER | Cancels and warmer entry | Beeps and 'PUSH START' |

Favorite Recipe mode is disabled during an active cooking mode, and FAVORITE RECIPE keypad 64 is ignored.

Figure 6:
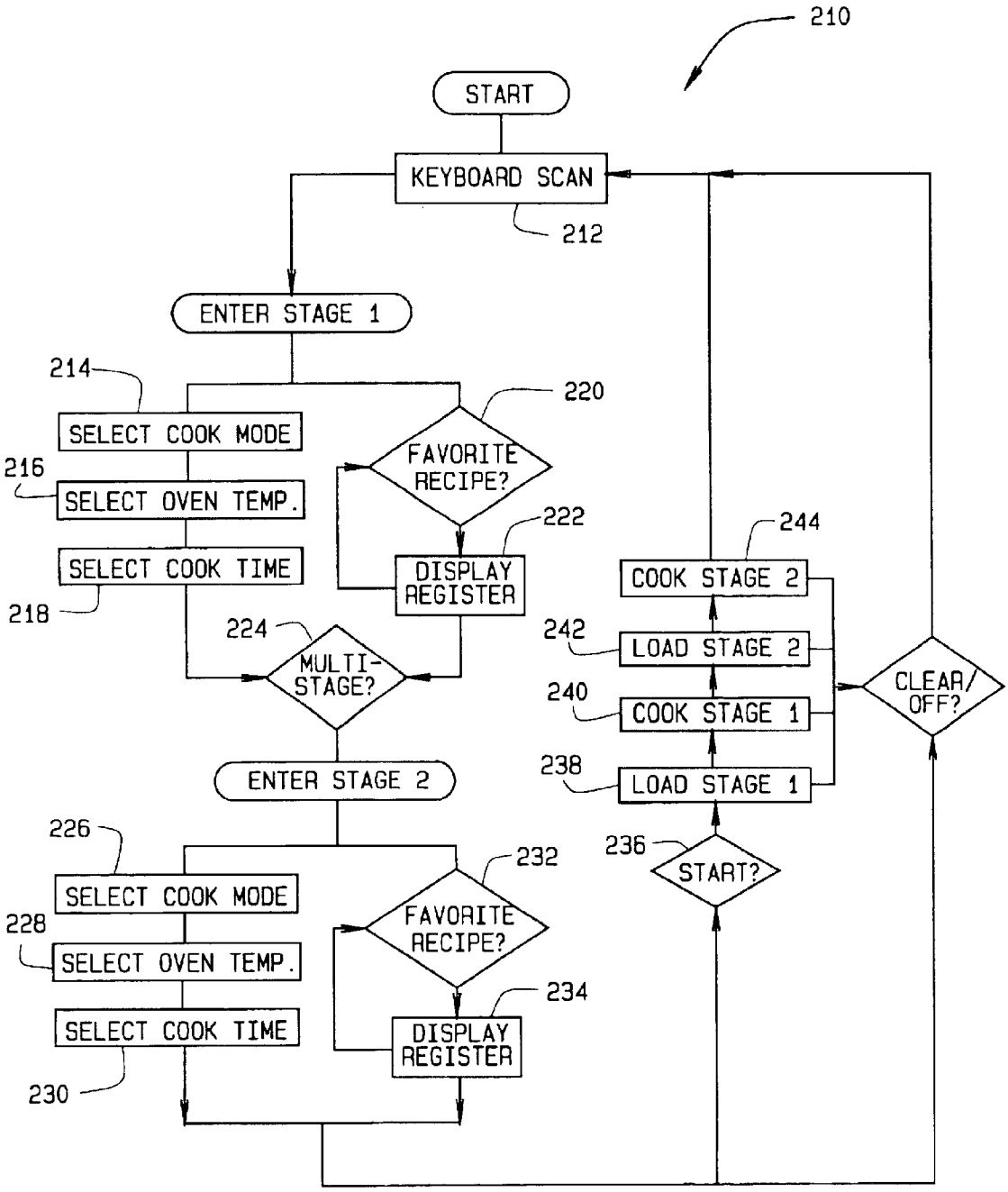
FIG. 6 is a method flowchart for a multi-stage cooking algorithm executable by the control system shown in FIG. 4.

FIG. 6 is a method flowchart for a multi-stage cooking algorithm 210 executable by control system 150 (shown in FIG. 4). Using the multi-stage cooking mode, oven settings are automatically adjusted between a first stage and a second stage at an appropriate time in a single cooking session without monitoring by a user. It is understood that multiple cooking recipes can be added as a logical extension of the above staged cooking sequence.

Input interface 34 (shown in FIG. 2) is scanned 212 for activation by the user. Cooking stage 1 may be manually entered by depressing one of BAKE 50, CONVECTION BAKE 58, or CONVECTION ROAST 60 keypads (shown in FIG. 2) to select 214 a cooking mode. Temperature up ( ) slew keypad 68 (shown in FIG. 2) or temperature down (v) slew keypad 40 is depressed to select 216 an oven temperature, and with each touch of slew keys 68, 70, a default temperature setting, such as 350° F. is increased or decreased by 5° F. A cooking time is selected 218 by pressing HOUR or MINUTE up (^) slew keypads 72, 76 (shown in FIG. 2) or HOUR or MINUTE down (v) slew keypads 74, 78. Alternatively, FAVORITE RECIPE keypad is depressed 220, repeatedly, if necessary, as described above until a stored favorite recipe is displayed 222 that is to be used as the "stage 1" of a multi-stage recipe.

When MULTI-STAGE keypad 66 is depressed 224, system 150 turns on the MULTI indicator 112 (shown in FIG. 3), sounds a notification tone, displays a blank temperature indicator 102 and time indicator 126, and alternatively flashes BAKE 110 and CONV 108 indicators. System 150 then waits for user entry of a "stage 2" recipe. Stage 2 may be manually entered by depressing one of BAKE 50, CONVECTION BAKE 58, or CONVECTION ROAST 60 keypads (shown in FIG. 2) to select 226 a cooking mode. Temperature up (^) slew keypad 68 (shown in FIG. 2) or temperature down (v) slew keypad 70 is depressed to select 228 an oven temperature, and with each touch of slew keys 68, 70, a default temperature setting is increased or decreased by 5° F. A cooking time is selected 230 by pressing HOUR or MINUTE up (^) slew keypads 72, 76 (shown in FIG. 2) or HOUR or MINUTE down (v) slew keypads 74, 78. Alternatively, FAVORITE RECIPE keypad 64 is depressed 232, repeatedly, if necessary, as described above until a stored favorite recipe is displayed 234 that is to be used as the "stage 2" of a multi-stage recipe.

Thus, two manually entered recipes, two favorite recipes, or a combination of manually entered and favorite recipes may be linked in multi-stage mode. Once the stages are entered, they are stored in RAM 154 (shown in FIG. 4), and the multi-stage recipe is executed by pressing 236 START keypad 80 (shown in FIG. 2). The stage 1 recipe is loaded 238 into a main cooking routine and stage 1 is executed 240. When stage 1 is completed, MULTI indicator 112 on display 40 is turned off, the stage 2 recipe is loaded 242 into the main cooking routine and stage 2 is executed 244. Multi-stage mode is exited by pressing CLEAR/OFF keypad 82. In an alternative exemplary embodiment, the multi-stage sequence is stored in permanent memory 156 and can be recalled and displayed at any of the recipe stages.

If no input interface keys are depressed and no cooking modes are active, i.e., the cooking elements are de-energized, system 150 times out, exits favorite recipe mode, and a "normal" display is indicated on display.

In multi-stage mode, while stage 1 is being executed, pressing MULTI-STAGE keypad 66 momentarily displays the stage 2 recipe, and then returns to the display indicated before MULTI-STAGE keypad 66 was depressed. When stage 2 is being executed, pressing MULTI-STAGE keypad 66 has no effect.

In one embodiment, pre-heat time is added to stage 1 when the stage 1 recipe is entered, and a preheat time sounds so that food may be placed into oven.

Figure 7:
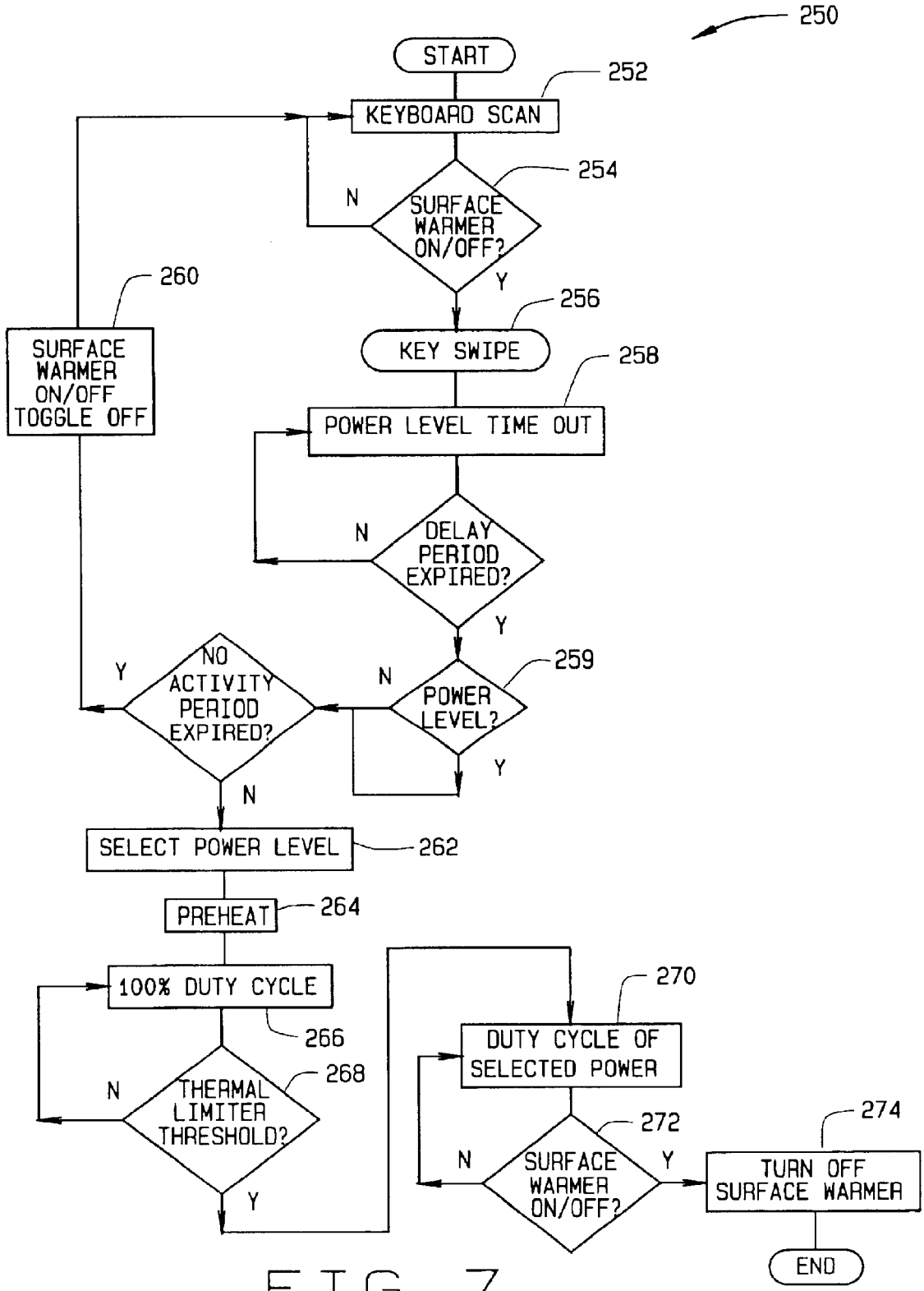
FIG. 7 is a method flowchart for a surface warmer control algorithm executable by the control system shown in FIG. 4.

FIG. 7 is a method flowchart for a surface warmer control algorithm 250 executable by control system (shown in FIG. 4). Input interface 34 (shown in FIG. 2) is scanned 252 for activation by the user, and when SURFACE WARMER on/off keypad 96 (shown in FIG. 2) is depressed 254, a keypad swipe detect algorithm is entered 256 to prevent unintended operation of surface warmer 28 (shown in FIG. 1) due to, for example, a wiping action over input interface during cleaning of oven 10 (shown in FIG. 1). After SURFACE WARMER on/off keypad 96 is once depressed 254 and toggled on, the surface warmer POWER LEVEL keypad 90 is temporarily timed out or inactivated 258 for a predetermined delay period. After the delay period has expired, POWER LEVEL keypad 93 is activated, and system 150 (shown in FIG. 4) waits for surface warmer POWER LEVEL keypad 90 to be depressed 259, and if POWER LEVEL keypad 90 is not depressed 259 during a predetermined no activity period, such as 10 seconds, system 150 times out and SURFACE WARMER on/off keypad 96 is toggled off 260. In this manner, power is applied to surface warmer 28 only when SURFACE WARMER on/off keypad 96 and POWER LEVEL keypad 90 are sequentially activated in a predetermined sequential time sequence, thereby reducing or eliminating unintentional activation of surface warmer 28 via incidental contact with input interface.

When the predetermined keypad sequence is executed, surface warmer SET and WARMER indicators 124, 128 (shown in FIG. 3) are lit on display 40, and time indicator 126 displays a default power setting of "0" in the fourth digit, i.e., the last digit on the right end of time indicator 126. A remainder of time indicator 126 is not illuminated. System 150 waits for a surface warmer power level to be selected 262. It is understood that other power indicators internal or external to display 40 can be used in lieu of the above-described embodiment.

If the POWER LEVEL keypad 90 is pressed once, a power setting of "1" is displayed in the fourth digit of time indicator 126, warmer ON indicator 132 is illuminated, and warmer HOT indicator 130 is also illuminated. Power is automatically applied to surface warmer 28 (shown in FIG. 1); START keypad 80 need not be depressed.

In one embodiment, a surface warmer preheat algorithm is entered 264 in which power is applied 266 to surface warmer 28 at a 100% duty cycle until a thermal limiter input switch in thermal communication with surface warmer indicates that a selected temperature of surface warmer is achieved 266, e.g., 150° F., and power is then applied 270 at lesser duty cycles to maintain an operating temperature or power level of surface warmer 28. Therefore, even at the lowest power setting, surface warmer 28 is quickly heated to its operating temperature at full power. The preheat algorithm increases response time of surface warmer, as well as prevents film buildup that may occur at low and medium power settings. In one embodiment, a 23.6 duty cycle is employed, and surface warmer power settings operate as follows:

| SETTING | TIME ON | TIME OFF |
|---|---|---|
| 1 (Low) | 7.2 seconds | 16.4 seconds |
| 2 (Medium) | 13.0 seconds | 10.6 seconds |
| 3 (High) | 19.0 seconds | 4.6 seconds |

Pressing POWER LEVEL keypad 90 repeatedly indexes through the power levels "1," "2," and "3" and the corresponding power level is indicated in the fourth digit of time indicator 126. If the power settings are indexed beyond the highest power setting, microprocessor 152 reverts to the lowest power setting to continuously index through the power settings. SET indicator 124 (shown in FIG. 3) flashes when POWER LEVEL keypad 90 is depressed, and SET indicator 124 is turned off upon the expiration of a predetermined no activity delay.

In an exemplary embodiment, surface warmer power levels are selected for warming particular items, such as those in the table below.

| SETTING | FOOD |
|---|---|
| 1 (Low) | Bread/Pastries |
| 1 (Low) | Chocolate |
| 2 (Medium) | Plate of food |
| 2 (Medium) | Sauces, Stews, Cream Soups |
| 2 (Medium) | Vegetables |
| 3 (High) | Soups (liquid) |
| 3 (High) | Tea or Coffee |

When surface warmer function is active but display 40 is in another mode, such as, for example, an active cooking mode wherein time indicator 126 displays a cooking time, or a normal mode wherein time indicator 126 displays a time of day, depressing POWER LEVEL keypad 90 causes microprocessor 152 to display the current surface warmer power level setting and SET indicator 124 is flashed on display 40.

If surface warmer 28 is activated and SURFACE WARMER on/off keypad 96 is depressed 272, surface warmer 28 is de-energized 274 and surface warmer ON indicator 132 is turned off. Surface warmer HOT and WARMER indicators 130, 128 remain lit, even after power to surface warmer is removed, until a temperature of the thermal limiter input switch falls below a predetermined threshold.

As a safety feature, input interface 34 is locked when control lock out keypad 84 is depressed for five seconds in one exemplary embodiment. If control lock out keypad 84 is depressed and held for five seconds, all power is removed from oven cooking elements, all functions are terminated, and "Loc" is displayed on display 40 in temperature indicator 102 while time indicator 126 displays time of day. All input keypads are deactivated when interface 34 is locked. Input interface 34 is unlocked by pressing a designated keypad or selection of keys in a pre-designated sequence. It is understood that in alternative embodiments, other indicators for a locked interface may be displayed, and greater or lesser lock activation and deactivation times as well as other lock activation and deactivation key sequences may be used.

Figure 8:
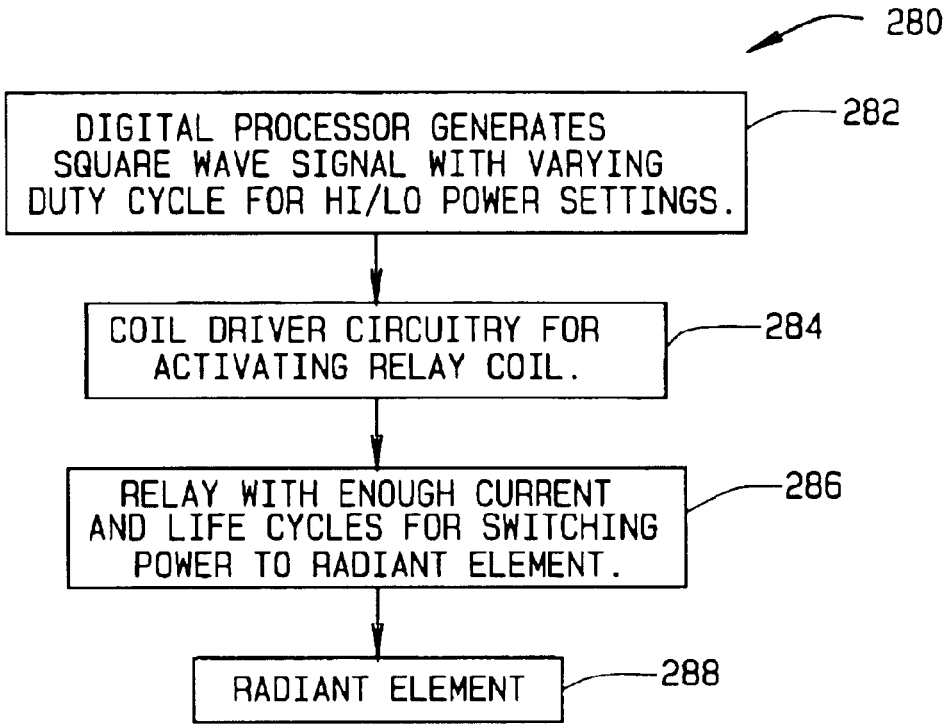
FIG. 8 is a block diagram for a first embodiment of a surface warmer for the oven shown in FIG. 1.

FIG. 8 is a block diagram for a first embodiment of a surface warmer 280 for oven 10 (shown in FIG. 1). A microprocessor 282 generates a square wave signal with a variable duty cycle for maintaining desired duty cycles. The signal is input into coil driver circuitry 284 to activate a surface warmer relay coil 286 with adequate current for switching power to a surface warmer radiant heating unit 288 for an adequate number of switching cycles.

Figure 9:
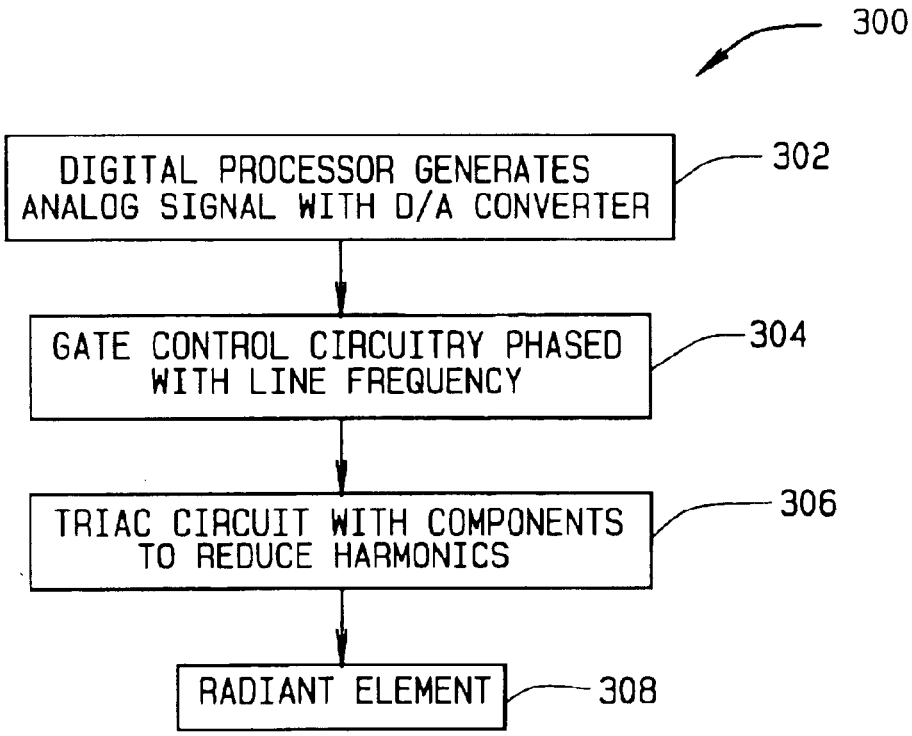
FIG. 9 is a block diagram of a second embodiment of a surface warmer for the oven shown in FIG. 1.

FIG. 9 is a block diagram of a second embodiment of a surface warmer 300 for oven 10 (shown in FIG. 1) wherein a microprocessor 302 is coupled to a digital-to-analog converter for driving gate control circuitry 304 phased with line frequency with an analog signal. The gate circuitry includes one or more triac circuits 306 for reduced harmonics that cycle power to a surface warmer radiant heating element 308.

While the invention has been described in terms of various specific embodiments, those skilled in the art will recognize that the invention can be practiced with modification within the spirit and scope of the claims.

What is claimed is:

1. A method for controlling an oven, the oven including at least one cooking element and at least one control system coupled to the cooking element, the control system including a processor, a memory, and an input interface, said method comprising the steps of:

receiving an initial stage user programmed cooking recipe of a multi-stage cooking operation;

storing the initial stage cooking recipe in system memory:

receiving at least one subsequent stage user programmed cooking recipe of a multi-stage cooking operation;

storing the subsequent stage cooking recipe in system memory; and executing the initial and subsequent stage cooking recipes sequentially without further user input.

2. A method in accordance with claim 1 wherein said step of receiving the initial stage cooking recipe comprises the step of receiving a cooking mode, an oven temperature, and a cooking time.

3. A method in accordance with claim 2 wherein said step of receiving the initial stage cooking recipe comprises the step of recalling a previously programmed user-entered cooking recipe stored in system memory.

4. A method in accordance with claim 2 wherein said step of receiving the initial stage cooking recipe comprises the step of receiving a user entered cooking recipe from the input interface.

5. A method in accordance with claim 1 wherein said step of receiving at least one subsequent stage cooking recipes comprises the step of receiving a cooking mode, an oven temperature, and a cooking time.

6. A method in accordance with claim 5 wherein said step of receiving at least one subsequent stage cooking recipe comprises the step of recalling a previously programmed user-entered cooking recipe stored in system memory.

7. A method in accordance with claim 5 wherein said step of receiving at least one subsequent stage cooking recipe comprises the step of receiving a user entered cooking recipe from the input interface.

8. A method for controlling an oven, the oven including at least one cooking element and at least one, control system coupled to the cooking element, the control system including a processor, a memory, and an input interface, said method comprising the steps of:

receiving at least one user programmed cooking recipe from the input interface;

storing the cooking recipe in system memory;

recalling the user programmed cooking recipe when requested by the user;

receiving a subsequent user programmed cooking recipe from the input interface; and sequentially executing the recalled recipe and the subsequent recipe without further user input.

9. A method in accordance with claim 8 wherein said step of receiving the cooking recipe comprises the step of receiving a cooking mode, an oven temperature, and a cooking time.

10. A method in accordance with claim 9, the control system further including a display, said step of recalling the user programmed recipe comprising the steps of:

displaying at least one stored recipe on the display; and executing the displayed recipe when selected by a user.

11. A method in accordance with claim 8 further comprising the step of deleting a stored cooking recipe upon user command via the input interface.

12. A control system for an oven including at least one cooking element, said control system comprising:

at least one microprocessor operatively coupled to the at least one cooking element;

at least one memory for storing cooking element command recipes for execution by said microprocessor;

at least one display coupled to said microprocessor for displaying operating conditions and oven features; and at least one user input interface coupled to said microprocessor for user entry of cooking recipes, said microprocessor and said memory configured to execute at least one of a user-programmed multi-stage cooking recipe and a user programmed recalled recipe in response to manipulation of said user input interface, said multi-stage cooking recite including oven settings that are automatically adjusted between a first stage and a second stage without monitoring by the user.

13. A control system in accordance with claim 12 wherein said microprocessor and said memory are configured to execute cooking element command recipes comprising a cooking mode, an oven temperature, and a cooking time.

14. A control system in accordance with claim 13 wherein said microprocessor and said memory are configured to execute a multi-stage cooking recipe without intervention by a user, said multi-stage cooking recipe comprising a first cooking mode, a first oven temperature, and a first cooking time followed by at least a second cooking mode, at least a second oven temperature, and at least a second cooking time.

15. A control system in accordance with claim 12, the oven further including at least one surface warmer operatively coupled to said microprocessor and operable at a plurality of power levels, said input interface comprising at least a first surface warmer operation input selector and a second surface warmer operation input selector, said microprocessor configured to operate the surface warmer only upon manipulation of said first and at least said second surface warmer input selectors within a pre-determined time.

16. A control system in accordance with claim 15 wherein said microprocessor is configured to preheat the at least one surface warmer when selected by a user.

17. A control system in accordance with claim 16 wherein the oven further includes a thermal limiter input switch coupled to said microprocessor, said microprocessor configured to apply a 100% duty cycle to the at least one surface warmer until the thermal limiter input switch reaches a predetermined temperature.

18. A control system in accordance with claim 17 wherein said microprocessor is configured to display an indicator on said display when a temperature of the thermal limiter exceeds a predetermined threshold value.

19. A control system in accordance with claim 12, said microprocessor further configured to lock-out said interface when a designated interface manipulation sequence is performed by a user.

* * * * *

UNITED STATES PATENT AND TRADEMARK OFFICE

CERTIFICATE OF CORRECTION

PATENT NO. : 6,809,301 B1
DATED : October 26, 2004
INVENTOR(S) : McIntyre et al.

It is certified that error appears in the above-identified patent and that said Letters Patent is hereby corrected as shown below:

Column 10,
Line 53, delete "recite" and insert -- recipe --.

Signed and Sealed this

Sixteenth Day of May, 2006

JON W. DUDAS
*Director of the United States Patent and Trademark Office*